United States Patent [19]

Silver et al.

[11] 4,122,943

[45] Oct. 31, 1978

[54] VALVED TWO COMPARTMENT DISPENSING CONTAINER

[75] Inventors: Jules Silver, Norwich; Jerome Silverstein, North Franklin, both of Conn.

[73] Assignee: Jules Silver, Norwich, Conn.

[21] Appl. No.: 734,609

[22] Filed: Oct. 21, 1976

[51] Int. Cl.[2] ..... B65D 25/08

[52] U.S. Cl. ..... 206/221; 128/272.1; 215/DIG. 8; 222/145

[58] Field of Search ..... 222/145, 80, 188, 479; 206/219, 221, 222; 215/DIG. 8; 220/20.5; 128/218 M, 272.1

[56] References Cited

U.S. PATENT DOCUMENTS

| | | | |
|---|---|---|---|
| 2,487,236 | 11/1949 | Greenberg | 206/222 X |
| 2,527,991 | 10/1950 | Greenberg | 206/221 X |
| 2,527,992 | 10/1950 | Greenberg | 206/221 X |
| 3,255,752 | 6/1966 | Dick | 128/218 M |
| 3,314,563 | 4/1967 | Mounier | 206/221 X |
| 3,735,761 | 5/1973 | Hurschman et al. | 128/221.1 X |
| 3,802,604 | 4/1974 | Morane et al. | 222/83 |

*Primary Examiner*—Robert B. Reeves
*Assistant Examiner*—Charles A. Marmor
*Attorney, Agent, or Firm*—John A. Mitchell; Pasquale A. Razzano

[57] ABSTRACT

A dispensing container for combining and then dispensing two discrete materials includes a first open top container element for containing the first material, e.g. a fluid and a second container element having closed upper and lower ends for containing the other of the two materials, e.g. a powder or a liquid. The second container element is dimensioned to be telescopically received with its lower end within the open topped container element. A valve is provided in the lower end of the second container element for normally keeping the materials in the container elements separate but permitting fluid in the first container element to flow into the second container element upon depression of the second container element, thereby causing materials in the two containers to combine. The upper end of the second container element may be provided with a removable cover so that the mixed materials can be dispensed.

14 Claims, 7 Drawing Figures

FIG. 3
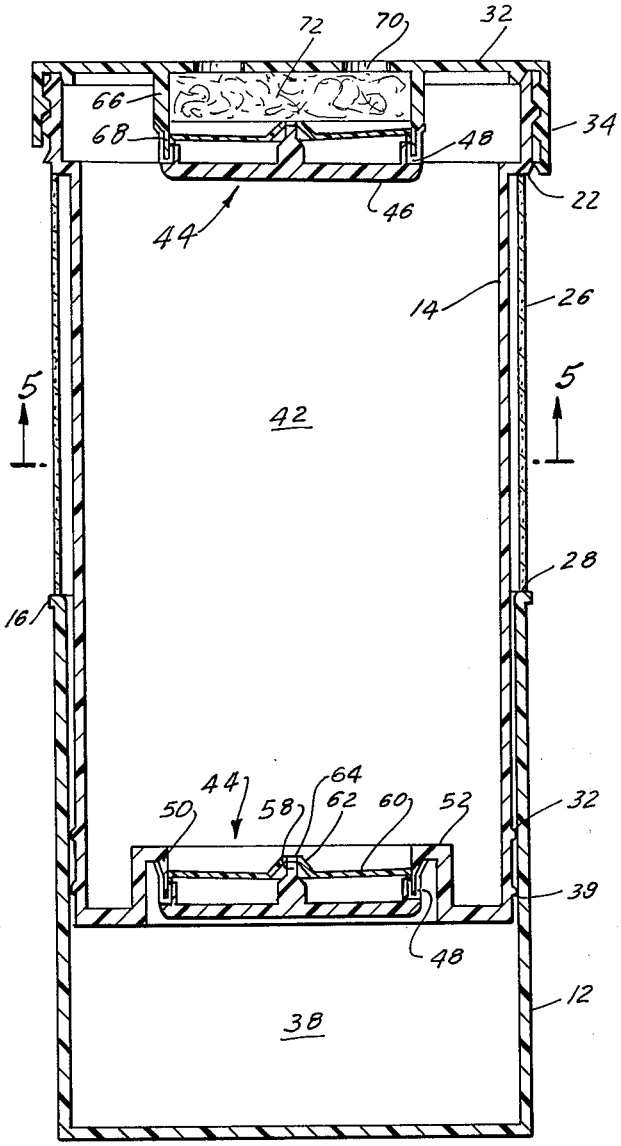
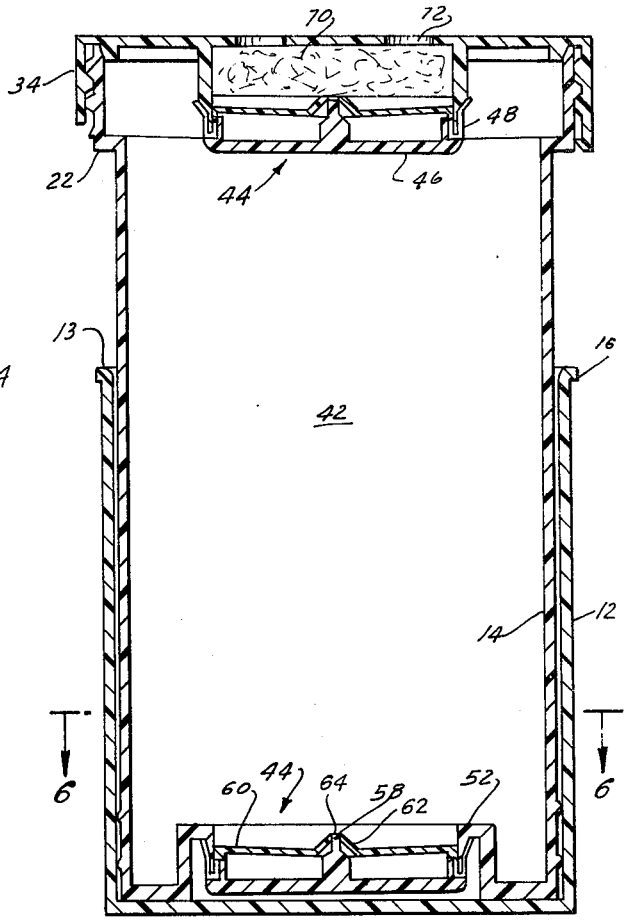
FIG. 4
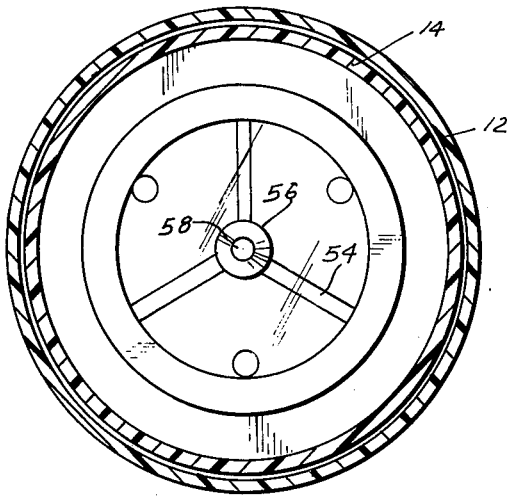
FIG. 6
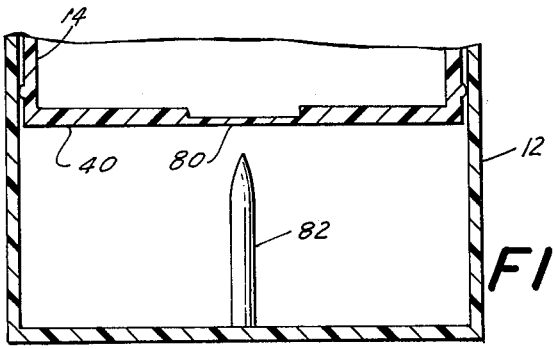
FIG. 7

VALVED TWO COMPARTMENT DISPENSING CONTAINER

The present invention relates to dispensers, and more particularly to a dispenser for containing and mixing two discrete materials.

In many commercial applications products are sold which consist of two discrete materials, such as two different fluids, or a fluid and a powder, which must be mixed by the consumer prior to use. The two materials are normally separately packaged, in separate containers, and the consumer must then open both containers and mix the ingredients in the desired proportions to prepare the final product for use. As a result, there is often spillage and improper proportionate mixing of the two ingredients. Moreover, additional packing space is required for the containers holding the separate products, and this results in additional spaced occupied in shipment, with the attendant increased costs associated therewith.

It is an object of the present invention to provide a single dispenser which can hold two discrete products or components, separated from each other during storage and shipment, but allowing the products to be mixed immediately prior to use.

Another object of the present invention is to provide a dispensing container for two separate products which is relatively simple in construction and inexpensive to manufacture.

A further object of the present invention is to provide a single container which can hold and permit mixing of two separate ingredients.

In accordance with an aspect of the present invention the dispensing container includes a first open topped container element and a second container element having normally closed upper and lower ends. The container of the present invention is somewhat similar in its basic construction to the container disclosed in U.S. Pat. Application Ser. No. 689,828 filed May 25, 1976 now U.S. Pat. No. 4,050,612 and commonly assigned herewith. The disclosure of that application is incorporated herein by reference.

In the dispenser of the present invention the second container element is dimensioned to be received with its lower end within the first container element and with a portion of the second container element extending above the open top of the first container element. A removable sleeve surrounds the portion of the second container element above the first or lower container element and is operatively engaged with the container elements for normally maintaining the first and second container elements in a predetermined fixed position with respect to each other. Each of the container elements holds a distinct product and the products are kept separated during storage and shipment of the dispenser.

The second container element is provided with a valve in its lower end which permits fluid in the first container element to flow into the second container element upon removal of the sleeve and depression of the second container into the first container whereby the products in the respective elements are mixed. The upper end of the second container element may be provided with a removable cover whereby the mixed products can be dispensed.

The term fluid as used herein is intended to include products which are either liquid, flowable powders or gas.

The above, and other objects, features and advantages of this invention will be apparent from the following description of an illustrative embodiment thereof, which is to be read in connection with the accompanying drawings, wherein:

FIG. 3 is a vertical sectional view of the dispenser of the invention in its assembled, storage position;

FIG. 4 is a sectional view similar to FIG. 3 of the dispenser after the contents of the two containers have been mixed;

FIG. 6 is a sectional view taken along line 6—6 of FIG. 4; and

FIG. 7 is a partial sectional view, similar to FIG. 3, of another embodiment of the present invention.

Figure 1:
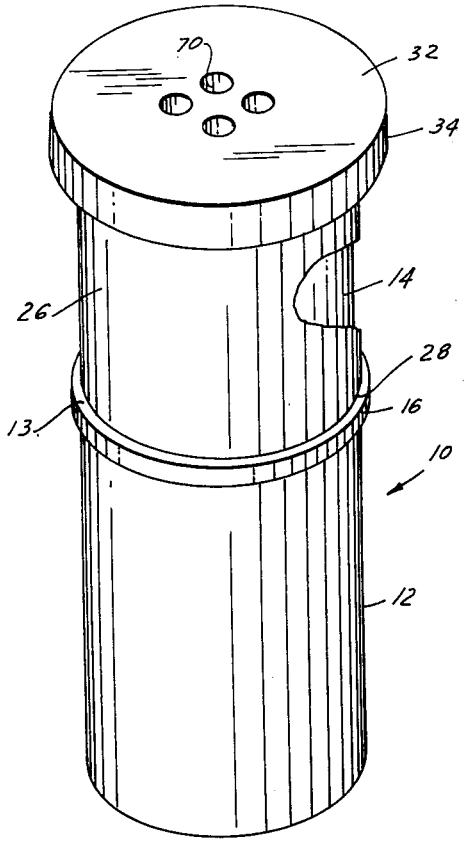
FIG. 1 is a perspective view of a dispensing container constructed in accordance with the present invention.

Referring now to the drawings in detail, and initially to FIG. 1 thereof the dispensing container 10, includes a first or bottom container element 12 having an open top 13 which telescopically receives a second or upper container element 14. Each of the container elements, as described hereinafter, holds a supply of material or fluid to be dispensed, and they are arranged so that upon depression of upper container 14 into lower container 12 the fluid from the lower container enters the upper container for mixing therewith.

Figure 2:
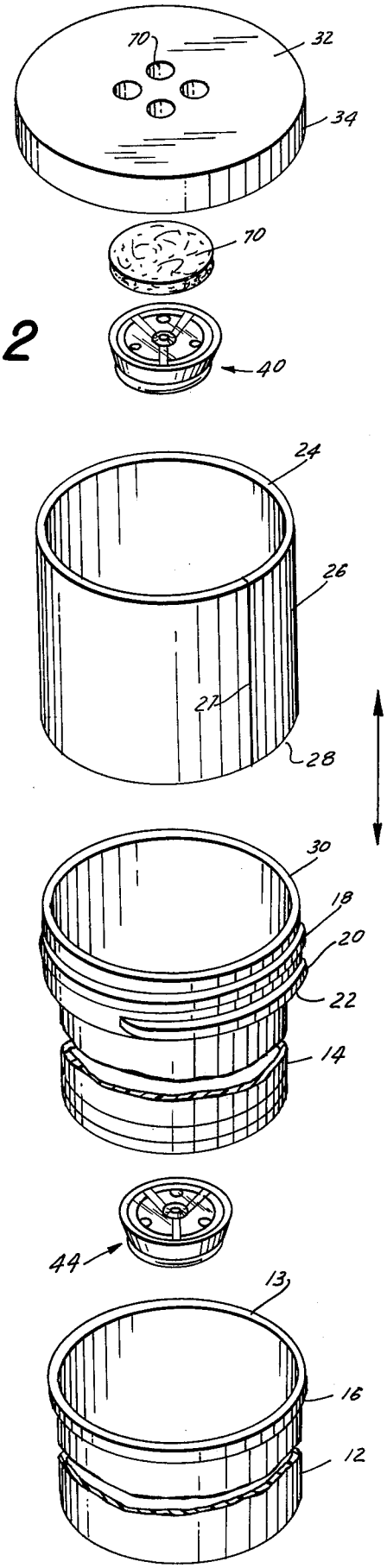
FIG. 2 is an exploded perspective view of the dispensing container illustrated in FIG. 1.

As seen most clearly in FIG. 2, the generally cylindrical lower container 12 has an outwardly extending flange 16 adjacent its upper opened end 13. The upper container 14 is also of generally cylindrical construction and has an outside diameter which is substantially equal to the inside diameter of lower container 12, so as to be telescopically received therein. Upper container 14 has an upper end portion 18 including an outwardly extending threaded periphery 20. The bottom edge of the threaded portion 20 defines a shoulder 22 (see FIG. 3) which cooperates with the upper edge 24 of a cylindrical paperboard sleeve 26 that is adapted to surround container element 14.

Sleeve 26 includes a lower edge 28 which engages the outwardly extending flange 16 of container 12 so as to support container element 14 within container element 12 in a predetermined position and prevent depression of container element 14 into the container element 12 until the sleeve is removed. The sleeve may be provided with a vertical tear strip 27 of conventional construction which will facilitate its removal from container element 14.

The upper end 18 of container element 14 defines a top opening 30 which is closed by a cover element 32. This cover has a downwardly extending flange 34 (see FIG. 3) which is internally threaded to cooperate with the threads 20 on container element 14 to form a substantially liquid tight seal.

As mentioned, the two container elements 12, 14 are adapted to hold different types of materials, i.e. materials which must be kept separated during storage and shipment, but which must be mixed together to form the final usable product. For example, in the hair coloring field, it is often necessary to mix a liquid with a powder in order to complete a reaction necessary to attain proper hair coloring or treatment. In accordance with the present invention, the liquid is contained within the chamber 38 defined in outer container element 12, below the base 40 of container element 14, while the internal chamber 42 of container element 14 contains the powder portion of the product.

In order to provide a proper liquid tight seal between container elements 14 and 12, the lower end portion of container element 14 can be provided with one or more ring protrusions 39 formed thereon about its periphery.

Figure 5:
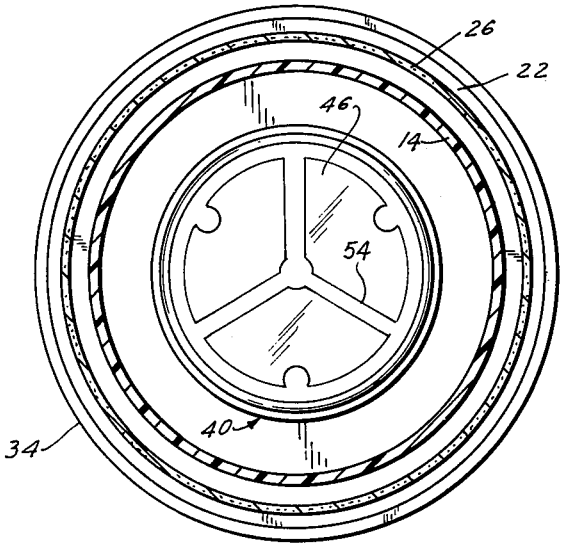
FIG. 5 is a sectional view taken along line 5—5 of FIG. 3.

In order to permit mixing of the liquid and powder products, upon removal of the sleeve 26, base 40 of container element 14 is provided with a valve 44. This valve is a one-way valve type construction which will permit liquid to flow from chamber 38 into chamber 42 but which will prevent powder from gravitating in the opposite direction. In the illustrative embodiment of the invention the valve 44 consists of an annular frame member having a circular periphery (see FIGS. 5 and 6) 46 having an upwardly opening groove 48 formed therein, as seen in FIG. 3. This groove receives the bottom edge 50 of an annular mounting wall 52 formed in the base of container element 14.

The periphery 46 of the valve has a plurality of radially extending spokes 54 formed integrally therewith terminating at the center of the frame in a central stud 56. This stud extends vertically in the valve, as seen in FIG. 3, to a tapered narrow end portion 58. A disc of relatively hard flexible plastic material 60 is mounted on the upper edge of the peripheral frame member 46 and is secured thereto by an adhesive, a heat seal, or friction fit. The disc has a central conically shaped portion 62 which includes a central opening 64 located directly in alignment with the tip 58 of the stud and receiving the tip therein. The engagement of the stud end 58 and opening 64 forms a liquid tight seal which will prevent the materials in either chambers 38 or 42 from passing through the opening.

When sleeve 26 is removed from about container element 14, and a downward pressure is applied to container element 14, the increased pressure on the liquid in chamber 38 urges the flexible disc 60 upwardly, disengaging stud end 58 from opening 64. This permits the liquid in chamber 38 to pass through opening 64 into chamber 42.

Although a specific type of valve has been described herein with respect to the preferred embodiment of the invention, it should be apparent that a variety of different types of one way valve elements can be used in lieu of the specific valve described.

After container element 14 has been fully depressed into container element 12, so that all of the material in chamber 38 has entered chamber 42, cover 32 can be unscrewed and the mixed contents in chamber 42 can be dispensed. In certain applications, it may be necessary to agitate the mixed products in order to insure proper mixing before cover 32 is removed.

In addition, certain types of products which must be kept separated during transportation and shipment will often produce a gas as a result of the chemical reaction between the two components when mixed in chamber 42. In order to permit escape of such reaction gases from chamber 42, before top 32 is opened, so as to insure against explosions, cover 32 may be provided with a valve 44 identical to the valve 44 in the base of the container element 14. In this case, as illustrated in FIG. 3, cover 32 includes a downwardly depending annular wall 66 whose free end 68 is received in the annular groove 48 on the periphery of valve 44. The valve is otherwise identical to the valve 40 previously described, and all of the elements therein are referenced by like reference numerals. In addition cover 32 is provided with openings 70 to permit gases to escape. If desired, an absorbent pad 72 can be placed within the annular support wall 66, above valve 40, so that only gas will escape from chamber 42 through openings 70, upon an increase in pressure within the chamber 42, with the absorbent pad absorbing any bubbles or liquid which would tend to be expelled with the gases through the valve.

In another embodiment of the invention, illustrated in FIG. 7, a different type of valve arrangement is shown. In this form the bottom wall 40 of container 14 includes, in lieu of valve 44 a thin rupturable diaphragm of 2 or 3 mill thickness, i.e. of substantially smaller thickness than the remainder of wall 40. This diaphragm is designed to rupture under a predetermined pressure such as would develop in chamber 38 upon depression of container element 14 in container element 12, thereby permitting the material in the two container elements to be mixed. This diaphragm may be a separate element mounted in container 14 in any convenient manner or it may be integrally molded with the container. Alternatively, to insure rupture of diaphragm 80, the base of container 12 may have a piercing element 82 formed therein to pierce diaphragm 80 upon downward movement of container element 14. In either case, it is clear that diaphragm 80 acts as a valve to separate chambers 38, 42 when desired and to permit material in chamber 38 to flow into chamber 42 when container element 14 is depressed into container element 12. Thus, as used in this application the terms valve and valve means are intended to encompass rupturable diaphragms such as the diaphragm 80.

Accordingly, it is seen that a relatively simply constructed container is provided which can dispense a mixed product after having kept the product components separated during shipment and storage. The container is very compact while holding product components separated, and thus reduces the packaging required with previously proposed packaging systems for separate component products. The provision of the valved dispenser of the present invention permits the consumer to readily mix the properly proportioned components in a totally closed system, thus obviating the need to open any of the container elements until after the mixture is completed. This is accomplished without danger of explosion and ready release of the gases, produced by mixing of the product components, through the valve arrangement in the cover 32.

Although an illustrative embodiment of the invention has been described herein with reference to the accompanying drawings, it is to be understood that the invention is not limited to that precise embodiment and that various changes and modifications can be effected therein by one skilled in the art without departing from the scope or spirit of the invention.

What is claimed is:

1. A container comprising a first open topped container element and a second container element having closed upper and lower ends and dimensioned to be received with its lower end within said open topped container element, one way valve means in said lower end of said second container element for permitting fluid to flow in only one direction between said containers from said first container element into said second container element; said second container element including one way valve means in its upper end for permitting fluid to flow in only one direction from said second container element to escape from said second container element to the atmosphere when the pressure in said second container element is above a predetermined level.

2. A container as defined in claim 1 wherein said second container element includes a removable cover at its upper end; said valve means in said upper end of the second container element being mounted in said cover.

3. A container as defined in claim 1 including means for selectively preventing movement of said second container element downwardly into said first container element.

4. A container as defined in claim 3 wherein said first container element includes an outwardly extending shoulder adjacent its upper end and said second container element includes means defining an outwardly extending shoulder adjacent its upper end; said movement preventing means comprising a collar surrounding a portion of said second container element extending beyond the first container element and having opposite ends engaged with said shoulders.

5. A container as defined in claim 4 wherein said collar comprises a paperboard sleeve.

6. A container as defined in claim 1 including means adjacent the lower end of said second container element for forming a substantially liquid impervious seal between said container elements.

7. A container comprising a first open topped container element, a second container element having normally closed upper and lower ends and being dimensioned to be received with its lower end within said first container element with a portion of the second container element extending above the open top of said first container element; removable sleeve means surrounding a portion of the second container element above said first container element and operatively engaged with said container elements for normally maintaining said second container element in a predetermined fixed position; and one way valve means in said lower end of said second container element for permitting fluid to flow in only one direction between said container from said first container element into said second container element upon removal of said sleeve and depression of the second container element into the first container element; said second container element including one way valve means in its upper end for permitting fluid to flow in only one direction from said second container element to escape from said second container element to the atmosphere when the pressure in said second container element is above a predetermined level; said second container element including a removable cover at its upper end and said one way valve means in said upper end of the second container element being mounted in said cover.

8. A container as defined in claim 7 including a liquid absorbing pad mounted in said second container element adjacent the valve means at its upper end for absorbing liquid and permitting only gas to pass through said valve at said upper end of said second container element.

9. A container as defined in claim 7 wherein said second container element includes a removable cover at its upper end; said valve means in said upper end of the second container element being mounted in said cover.

10. A container as defined in claim 9 wherein said cover and second container element have cooperating threads formed thereon for threadably securing said cover to said second container element.

11. A container as defined in claim 9 wherein said first container element has an outwardly extending peripheral flange formed integrally therewith adjacent its open top and said upper end of said second container has an outwardly extending peripheral shoulder formed thereon; said sleeve means having opposed end portions respectively engaged with said flange and shoulder for normally preventing downward movement of said second container element into said first container element.

12. A container as defined in claim 11 wherein said sleeve means comprises a paper board sleeve.

13. A container as defined in claim 11 including means adjacent the lower end of said second container element for forming a substantially liquid impervious seal between said container elements.

14. A container as defined in claim 11 wherein said first and second container elements are cylindrical.

* * * * *